United States Patent [19]

Brammer

[11] Patent Number: 4,893,842

[45] Date of Patent: Jan. 16, 1990

[54] WELLHEAD TIEBACK SYSTEM WITH LOCKING DOGS

[75] Inventor: Norman Brammer, Scotland, United Kingdom

[73] Assignee: Vetco Gray Inc., Houston, Tex.

[21] Appl. No.: 250,022

[22] Filed: Sep. 27, 1988

[51] Int. Cl.[4] ..... F16L 35/00

[52] U.S. Cl. ..... 285/24; 285/39; 285/315

[58] Field of Search ..... 285/39, 315, 313, 18, 285/24

[56] References Cited

U.S. PATENT DOCUMENTS

| | | | |
|---|---|---|---|
| 3,489,436 | 1/1970 | Ahlstone | 285/315 X |
| 4,343,495 | 8/1982 | Nobileau et al. | 285/39 X |
| 4,372,584 | 2/1983 | Miller | 285/315 X |
| 4,451,056 | 5/1984 | Galle | 285/315 X |
| 4,696,493 | 9/1987 | Brummer | 285/39 X |

*Primary Examiner*—Dave W. Arola

*Attorney, Agent, or Firm*—James E. Bradley

[57] ABSTRACT

A conductor tieback connector is connected to the lower end of a string of risers and has a downwardly extending funnel that fits over a wellhead. A two-piece internal floating bushing is moved within the interior of the wellhead from an upper position to a lower engaged postion. Locking dogs are pushed outward by an outer ring which is rotated by a running tool. These locking dogs engage grooves in the wellhead. The locking dogs and the wellhead grooves have inclined load shoulders. The dimensions between the abutting surfaces of the wellhead connector and the load shoulders are selected so as to create a preload force.

5 Claims, 2 Drawing Sheets

WELLHEAD TIEBACK SYSTEM WITH LOCKING DOGS

BACKGROUND OF THE INVENTION

1. Field of the Invention:

This invention relates to offshore subsea well apparatus and in particular to a connector for connecting a tieback conductor to a wellhead located subsea.

2. Description of the Prior Art:

U.S. Pat. No. 4,343,495, Philippe C. Nobileau et al, Aug. 10, 1982, describes the need for running of tieback conductors from a platform deck to a subsea wellhead. The tubular connector utilizes a tapered guide funnel for initial stabbing and bearing surfaces which operate on the outside surface of the wellhead to force the conductor string into angular alignment with the wellhead under the influence of the weight of the conductor string. Seals located between the tieback connector and the wellhead are compressed with axial movement of the tieback connector, and thereafter a lock-down bushing engages internal running tool threads on the wellhead and clamps the wellhead without rotation of the conductor.

Such a tieback connector solves angular misalignment problems between the conductor and the wellhead when the conductor approaches the wellhead, and solves the problem of damage to the seals by the elimination of conductor rotation for makeup.

The tieback connector of the foregoing patent with its lock-down bushing, therein also referred to as a floating bushing, requires threads on the internal bore of the wellhead for makeup. In U.S. Pat. No. 4,696,493, Norman Brammer, Sept. 29, 1987, a tieback system is shown that is adapted to engage circumferential grooves in the wellhead, rather than internal threads in the wellhead. This tieback system utilizes a bushing having an inner and outer ring. The outer ring carries locking elements. The inner ring, when rotated downward, moves the locking elements out into engagement with the grooves.

SUMMARY OF THE INVENTION

The conductor tieback connector in this invention has a tubular body connectible to the lower end of a conductor or a string of conductors, a downward extending funnel with two bearing surfaces and a tapered guide. The tapered guide aids in initial stabbing of the connector over the wellhead, and the two bearing surfaces operate on the outside of the wellhead to force the tieback connector into angular alignment under the influence of the weight of the conductor string. Seals, located between the tieback connector and wellhead, are compressed with axial movement of the tieback connector.

The tieback connector also includes a two-piece internal floating bushing, threadible on the interior surface of the tieback connector, which is moved within the interior of the wellhead where locking dogs engage running tool grooves in the bore of the wellhead to clamp the tieback connector onto the wellhead.

The wellhead groove has a downward and inward facing load shoulder that mates with an upward and outward facing load shoulder on the locking dogs. The locking dogs are carried on the inner ring at a dimension that is selected so that they will not be fully located with the grooves when the tieback connector tubular body is in abutment with the wellhead. Also, the mating surfaces of the outer ring and the locking dogs are preferably tapered. The positioning of the locking dogs and the inclined load shoulders creates a preload force on the seals located at the abutting surface of the wellhead and the tieback connector.

DESCRIPTION OF THE PREFERRED EMBODIMENT

Figure 1:
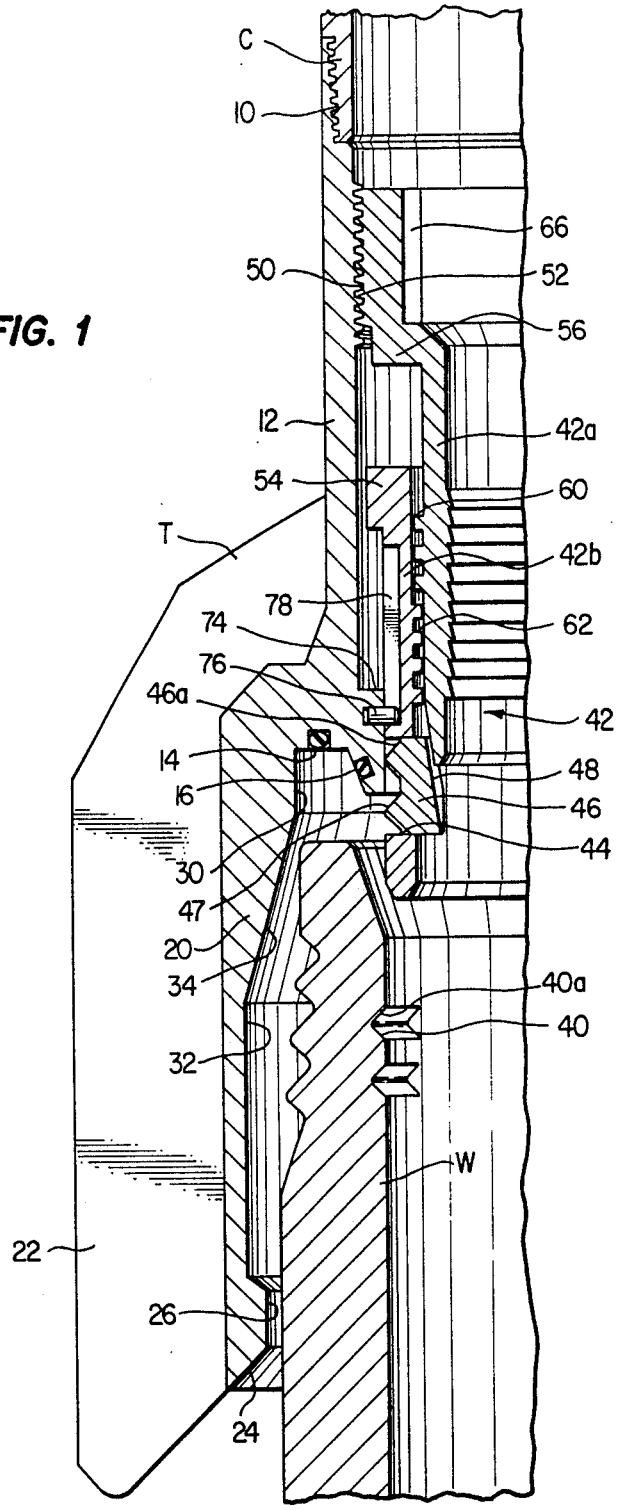
FIG. 1 illustrates the tieback connector as it approaches the wellhead.

In FIG. 1 a wellhead W is located near the seabed (not shown). To tieback the wellhead to a platform, also not shown, an external riser or conductor C is connected and sealed to the wellhead W. Conductor C is the lowermost conductor of a string of conductors extending back to the platform and is connected to tieback connector T of this invention in any suitable manner such as threads 10. The tieback connector T includes an upper tubular body 12, and seal grooves 14 where seal rings 16 may be contained at a location for sealing with the wellhead W.

The lower portion of the tieback connector T is a cylindrical bell-shaped funnel 20 which is securely attached and integral with the tubular body 12. This funnel 20 may include on its outer surface a plurality of guide ribs 22 which are tapered at their lower ends faring uniformly into a tapered surface 24 at the lower end of the funnel 20.

If the tieback connector T approaches the wellhead W with some horizontal offset, the lower edge of the guide ribs 22 and the tapered surface 24 interact with the upper edge of the wellhead W. The weight of the conductors forcing the tieback connector T downwardly causes the conductor C and the string of conductors to deflect laterally and circle the wellhead W. The funnel 20 includes a lower bearing surface 26 which has an internal diameter only slightly greater than the outside diameter of the wellhead W. This provides accurate guidance of the lower end of the tieback connector T.

An upper bearing surface 30 also has a diameter only slightly greater than the outside diameter of the wellhead W. The funnel 20 at an intermediate section 32 between the first and second bearing surfaces 26, 30 has a diameter greater than that of either of the bearing surfaces 26, 30. The diameter of this intermediate section 32 gradually approaches that of the second bearing surface to form an internal conical surface 34.

As the tieback connector is lowered with the first bearing surface 26 engaged, the internal intermediate section 32 rides at the top of the wellhead followed by the conical surface 34, and ultimately the upper bearing surface 30 is engaged. Interaction between the two bearing surfaces 26,30 and the outside surface of the wellhead W applies a bending moment to force the string of conductors into alignment with the wellhead W. The weight of the conductors applies the driving force which may be augmented with a connector tool described hereinafter. Selection of tolerances between the various diameters should be such that this forces axial alignment within preferably 0.1 degrees.

At this time the abutting surfaces of the wellhead W and the tieback connector T contact in the area of the seals 16, which are compressed against the upper surface (end) of the wellhead W. Only the weight of the conductor string operates to initially compress the seals.

The bore of the wellhead W contains two circumferential parallel grooves 40. Each groove is triangular in cross-sectional configuration. Each groove 40 has a load shoulder 40*a* that extends from a base of the groove and faces or inclines downward and inward relative to the longitudinal axis of wellhead W. The base of each groove 40 is located in a plane perpendicular to the axis of the wellhead W.

A floating bushing 42 comprises two pieces or rings; inner ring 42*a* and outer ring 42*b*. Outer ring 42*b* has openings 44 which contain locking elements or dogs 46 (one shown) adapted to mate with the grooves 40. Each dog 46 has on its outer face a pair of protruding teeth 47, each having the same triangular configuration as the grooves 40. The teeth 47 include a pair of load shoulders 46*a* each of which face upward angle relative to the longitudinal axis of the tubular body 12 for mating with the load shoulders 40*a* of the grooves 40.

Also, each dog 46 has on its inner side a tapered wedge surface 48. The wedge surface 48 is a segment of a frusto-conical surface of revolution. The wedge surface 48 inclines inward from the top to the bottom at an acute angle relative to the longitudinal axis of the tubular body 12. Wedge surface 48 is adapted to mate with a tapered wedge surface 49 formed on the lower end of the inner ring 42*a*. Downward movement of the inner ring 42*a* will cause the wedge surface 49 to slide on the wedge surface 48, urging the dogs 46 outward. Wedge surface 49 inclines inward from the upper edge of the wedge surface downward at the same angle as the wedge surfaces 48.

The inner ring 42*a* also includes upper external threads 50 which mate with upper internal threads 52 on the upper tubular body 12. Both rings overlap and are connected together by complementary square threads 60, 62 on the inner and outer rings, respectively.

These upper threads 50,52 operate as retaining means to support the two-piece floating bushing 42 in an upper withdrawn and protected position during running of the conductor, as shown in FIG. 1. Prior to sealably connecting the tieback connector T to the conductor C, the two-piece floating bushing, inserted from the top of the connector T, is rotated to engage threads 50 with threads 52 on the upper body member 12.

The two-piece bushing 42 also includes vertical slots 66 (one shown) on inner ring 42*a* which provide a means for interlocking the bushing 42 with a rotating running tool (not shown) which may be constructed as shown in U.S. Pat. No. 4,696,493, Norman Brammer, all of which material is hereby incorporated by reference. The rotating tool may be run down and used to rotate the inner ring 42*a*, thereby releasing the bushing 42 from its upper position.

The outer ring 42*b* has a rim or collar 54 on its upper end which extends radially outward. Collar 54 is adapted to bear against an upward facing ledge 74 in the tubular body 12 when the bushing 42 is in the lower or locking position shown in FIG. 2. The distance from the lower side of the collar 54 to the upper edge of the dog's load shoulders 46*a* is slightly less than the distance from the ledge 74 to the upper edge of the groove load shoulder 40*a* when the tubular body 12 is located on the wellhead W.

A vertical, elongated slot 78 is formed in the outer ring 42*b* below the collar 54. A pin 76 extends radially inward from the interior of tubular body 12 to engage the slot 78. This engagement prevents rotational movement of the outer ring 42*b* relative to the tubular body 12.

In operation, the tieback connector T will be lowered over the wellhead W with the floating bushing 42 in the upper retracted position as shown in FIG. 1. The funnel 20 will land on the wellhead W, with the upper bearing surface 30 in contact with the upper edge of the wellhead W. The seals 16 will contact the upper end of the wellhead W.

Then, the running or rotating tool is lowered into engagement with the slot 66 of the inner ring 42*a*. Rotation causes the threads 50, 52 to unscrew. The bushing 42 will then drop. The longitudinal spacing of the threads 52 is such that the two-piece bushing 42 is released from engagement before the collar 54 engages ledge 74 in the tubular body member 12.

Continued rotation of the inner ring 42*a* causes the inner ring 42*a* to rotate downward relative to the outer ring 42*b*. The outer ring 42*b* remains stationary because of engagement of the pin 76 in the slot 78. The threads 60, 62 will cause the downward movement of the inner ring 42*a*. The wedge surface 49 will begin pushing the dogs 46 outward into engagement with the grooves 40. The load shoulders 46*a* will contact and slide on the groove load shoulders 40*a*.

Figure 2:
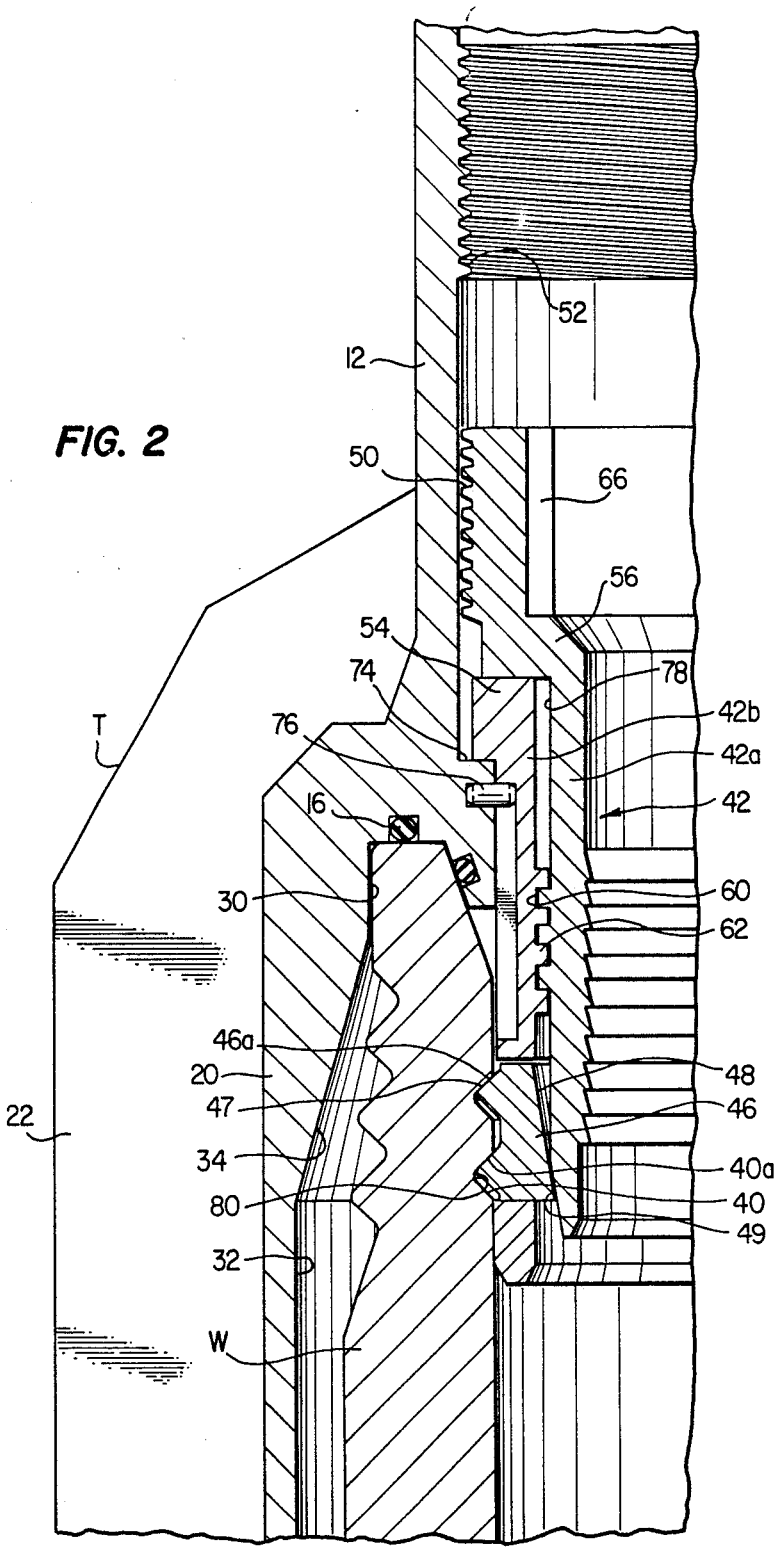
FIG. 2 illustrates the tieback connector in the locked position.

Because the distance from the lower side of the collar 54 to the upper load shoulder 46*a* of each dog 46 is less than the distance from the ledge 74 to the upper load shoulder 40*a* of the upper groove 40, the dogs 46 will exert a compressive force on the abutting surfaces between the tubular body 12 and the wellhead W. This provides a preload on the seals 16. When the dogs 46 are pushed to the outermost fully engaged position, the teeth 47 of the dogs 46 will not be fully located within the grooves 40, but will appear generally as shown in FIG. 2. At full make-up, a clearance 80 will exist between the outermost point of each load shoulder 46*a* and the base of each groove 40.

The radial movement of the dogs 46 is progressive to accommodate vertical tolerances in the system as the radial movement is translated into axial movement. A mechanical advantage exists between the inner ring wedge surface 49 and the wedge surfaces 48 due to the taper, so to generate the preload. A relatively low torque at the inner ring 42*a* generates a high preload at the interface of the dogs 46 with the grooves 40.

The invention has significant advantages. The location of the dogs and the inclined load shoulders provide a preload on the seals between the abutting surfaces of the wellhead and tieback connector.

While the invention has been shown in only one of its forms, it should be apparent to those skilled in the art that it is not so limited, but is susceptible to various changes without departing from the scope of the invention.

I claim:

1. In a conductor tieback connector for connecting a conductor to a subsea wellhead of the type having a tubular body sealably and rigidly connectible to the conductor, a downwardly opening funnel means connected to the tubular body for aligning the connector, and upward and downward facing abutting surfaces on the wellhead and the tubular body, respectively, for abutting when the tubular body is fully engaged within the wellhead, an improved lockdown means for locking the connector to the wellhead, comprising in combination:

at least one internal circumferential groove formed in the wellhead, the groove having a load shoulder that inclines downward and inward relative to a longitudinal axis of the wellhead;

an inner ring;

an outer ring;

means for carrying the inner ring within the outer ring;

means for carrying the rings in the tubular body;

a locking element;

a means for carrying the locking element with the outer ring for radial movement relative to the outer ring and for preventing any axial movement of the locking element relative to the outer ring, the locking element having an inner surface and a load shoulder that inclines upward and outward relative to a longitudinal axis of the outer ring for engaging the load shoulder of the groove;

the inner ring having an outer surface that is positioned for engaging an inner surface of the locking element;

an upward facing ledge formed internally within the tubular body;

a collar on the exterior of the outer ring for bearing against the ledge;

means in the inner ring for receiving a running tool for moving the inner ring downward relative to the outer ring and the tubular body, causing the inner ring outer surface to slide on the locking element inner surface to force the locking element outward into the groove; and the distance between the locking element load shoulder and the collar being slightly less than the distance between the ledge and the groove load shoulder when the abutting surfaces of the wellhead and tubular body engage each other, so as to cause an interfering engagement of the load shoulders, exerting a preload force on the abutting surfaces as the locking element load shoulder slides outward against the groove load shoulder.

2. In a conductor tieback connector for connecting a conductor to a subsea wellhead of the type having a tubular body sealably and rigidly connectible to the conductor, a downwardly opening funnel means connected to the tubular body for aligning the connector, and upward and downward facing abutting surfaces on the wellhead and the tubular body, respectively, for abutting when the tubular body is fully engaged within the wellhead, an improved lockdown means for locking the connector to the wellhead, comprising in combination:

at least one internal circumferential groove formed in the wellhead, the groove having a load shoulder that inclines downward and inward relative to a longitudinal axis of the wellhead;

an inner ring;

an outer ring;

means for carrying the inner ring within the outer ring;

means for carrying the rings in the tubular body;

a locking element;

means for carrying the locking element with the outer ring for radial movement relative to the outer ring and for preventing any axial movement of the locking element relative to the outer ring, the locking element having a load shoulder that inclines upward and outward relative to a longitudinal axis of the outer ring for engaging the load shoulder of the groove, the locking element having an inner wedge surface;

the inner ring having an outer wedge surface that is positioned for engaging an inner surface of the locking element wedge surface;

an upward facing ledge formed internally within the tubular body;

a collar on the exterior of the outer ring for bearing against the ledge;

means for preventing rotation of the outer ring relative to the tubular body;

mating threads formed on the inner and outer rings;

means in the inner ring for receiving a running tool for rotating the inner ring relative to the outer ring and the tubular body, causing the inner ring outer surface to slide on the locking element inner surface to force the locking element outward into the groove as the inner ring moves downward relative to the outer ring on the mating threads; and the distance between the locking element load shoulder and the collar being slightly less than the distance between the ledge and the groove load shoulder when the abutting surfaces of the wellhead and tubular body engage each other, so as to cause an interfering engagement of the load shoulders, exerting a preload force on the abutting surfaces as the locking element load shoulder slides outward against the groove load shoulder.

3. In a conductor tieback connector for connecting a conductor to a subsea wellhead of the type having a tubular body sealably and rigidly connectible to the conductor, a downwardly opening funnel means connected to the tubular body for aligning the connector, and upward and downward facing abutting surfaces on the wellhead and the tubular body, respectively, for abutting when the tubular body is fully engaged within the wellhead, an improved lockdown means for locking the connector to the wellhead, comprising in combination:

at least one internal circumferential groove formed in the wellhead, the groove having a base and having a frusto-conical load shoulder;

an inner ring;

an outer ring;

means for carrying the inner ring within the outer ring;

means for carrying the rings in the tubular body;

a plurality of locking elements;

means for carrying the locking elements with the outer ring for movement from an inward retracted position to an outward engaged position and for preventing any axial movement of the locking elements relative to the outer ring, each locking element having a shoulder for engaging the load shoulder of the groove when in the engaged position, each locking element having an inner tapered wedge surface;

the inner ring having an outer tapered wedge surface for engaging the wedge surfaces of the locking elements;

an upward facing ledge formed internally within the tubular body;

a collar on the exterior of the outer ring for bearing against the ledge;

means on the outer ring for preventing rotation of the outer ring relative to the tubular body;

mating threads formed on the inner and outer rings;

means in the inner ring for receiving a running tool for rotating the inner ring relative to the outer ring and the tubular body to cause the wedge surface of the inner ring to slide on the wedge surfaces of the locking elements to force the locking elements outward into the groove as the inner ring moves downward relative to the outer ring on the mating threads; and the distance between the load shoulders of the locking elements and the collar being slightly less than the distance from the load shoulder of the groove to the ledge when the tubular body lands on the wellhead, so as to cause an interfering engagement of the load shoulders and so that a clearance will exist between the load shoulders of the locking elements and the base of the groove when the locking elements are pushed to the outer engaged position, causing a preload force on the abutting surfaces of the wellhead and tubular body.

4. In a conductor tieback connector for connecting a conductor to a subsea wellhead of the type having a tubular body sealably and rigidly connectible to the conductor, a downwardly opening funnel means connected to the tubular body for aligning the connector, and upward and downward facing abutting surfaces on the wellhead and the tubular body, respectively, for abutting when the tubular body is fully engaged within the wellhead, an improved lockdown means for locking the connector to the wellhead comprising in combination:

at least one internal circumferential groove formed in the wellhead, the groove having a base and a load shoulder that faces downward and inward relative to a longitudinal axis of the wellhead;

a two-piece bushing having an inner ring and an outer ring, the bushing being movable between an upper position and a lower position relative to the tubular body;

means for slidably carrying the inner ring in the outer ring;

retaining means in the tubular body for releasably retaining the bushing in the upper position;

the outer ring having a cylindrical wall containing a plurality of apertures spaced around its circumference;

a plurality of locking elements;

means for carrying each of the locking elements in one of the apertures of the outer ring for movement from an inward retracted position to an outward engaged position protruding from each of the apertures, the locking elements fitting closely within the apertures so as to prevent any axial movement of the locking elements relative to the outer ring, each locking element having a load shoulder that inclines upward and outward relative to a longitudinal axis of the outer ring for engaging the load shoulder of the groove when in the engaged position, each locking element having an inner tapered wedge surface;

the inner ring having an outer tapered wedge surface for engaging the wedge surfaces of the locking elements;

an upward facing ledge formed internally within the tubular body;

a collar on the exterior of the outer ring for bearing against the ledge;

means on the outer ring for preventing rotation of the outer ring relative to the tubular body;

mating threads formed on the inner and outer rings;

means in the inner ring for receiving a running tool for moving the bushing from the upper position to the lower position and for rotating the inner ring relative to the outer ring and the tubular body to cause the wedge surface of the inner ring to force the locking elements outward into the groove as the inner ring moves downward relative to the outer ring on the mating threads; and the distance between the load shoulder of the locking elements and the collar being slightly less than the distance from the distance from the load shoulder of the groove and the ledge when the tubular body lands on the wellhead, to create an interference fit between the load shoulders, the base of the groove being positioned so that a clearance will exist between the load shoulders of the locking elements and the base of the groove when the locking elements are pushed to the outer engaged position, so as to cause a preload force on the abutting surfaces of the wellhead and tubular body.

5. In a conductor tieback connector for connecting a conductor to a subsea wellhead of the type having a tubular body sealably and rigidly connectible to the conductor, a downwardly opening funnel means connected to the tubular body for aligning the connector, and upward and downward facing abutting surfaces on the wellhead and the tubular body, respectively, for abutting when the tubular body is fully engaged within the wellhead, an improved lockdown means for locking the connector to the wellhead, comprising in combination:

at least one internal circumferential groove formed in the wellhead, the groove having a frusto-conical load shoulder;

a two-piece bushing having an inner ring and an outer ring, the bushing being movable axially between an upper position and a lower position relative to the tubular body;

means for slidably carrying the inner ring in the outer ring;

retaining means in the tubular body for supporting the bushing in the tubular body and for releasably retaining the bushing in the upper position;

the outer ring having a cylindrical wall containing a plurality of apertures;

a plurality of locking elements;

means for carrying each of the locking elements in one of the apertures for movement from an inward retracted position to an outward engaged position protruding from each of the apertures, the locking elements fitting closely within the apertures so as to prevent any axial movement of the locking elements relative to the outer ring, each locking element having a load shoulder for engaging the load shoulder of the groove when in the engaged position and when the bushing is in the lower position, each locking element having an inner wedge tapered wedge surface;

the inner ring having an outer tapered wedge surface for engaging the wedge surfaces of the locking elements;

an upward facing ledge formed internally within the tubular body;

a collar on the exterior of the outer ring for bearing against the ledge when the bushing is in the lower position;

a pin mounted to the interior of the tubular body in engagement with a vertically elongated slot formed in the outer ring for preventing rotation of the outer ring relative to the tubular body;

mating threads formed on the inner and outer rings;

means formed in the inner ring for receiving a running tool for moving the bushing from the upper position to the lower position and for rotating the inner ring relative to the outer ring and the tubular body to cause the wedge surface of the inner ring to force the locking elements outward into the groove as the inner ring moves downward relative to the outer ring on the mating threads; and the distance between the load shoulder of the locking elements and the collar being slightly less than the distance between the ledge and the groove load shoulder when the abutting surfaces of the wellhead and tubular body engage each other, so as to create an interference fit between the load shoulders to cause a preload force on the abutting surfaces as the locking element load shoulder slides outward against the groove load shoulder.

* * * * *

UNITED STATES PATENT OFFICE

CERTIFICATE OF CORRECTION

Patent No. 4,893,842 Dated 01/16/90

Inventor(s) Norman Brammer

It is certified that error appears in the above-identified patent and that said Letters Patent is hereby corrected as shown below:

At column 1, line 67, "with" is changed to--within--;

At column 2, line 40 "circle", is changed to--encircled--;

At column 3, line 19, a comma is inserted after "46a";

At column 3, line 19, after "upward", the following is inserted--and outward. Each load shoulder 46a is located at an--;

At column 8, line 14, "from the distance" is deleted;

At column 8, line 15, "and" is changed to--to--.

Signed and Sealed this

Twenty-first Day of January, 1992

*Attest:*

HARRY F. MANBECK, JR.

*Attesting Officer*

*Commissioner of Patents and Trademarks*